US011590757B2

(12) United States Patent
Arimizu et al.

(10) Patent No.: US 11,590,757 B2
(45) Date of Patent: Feb. 28, 2023

(54) DISCHARGE APPARATUS AND SUCTION UNIT

(71) Applicant: CANON KABUSHIKI KAISHA, Tokyo (JP)

(72) Inventors: Hiroshi Arimizu, Chiba (JP); Yoshinori Itoh, Kanagawa (JP); Motomi Tsuyuki, Kanagawa (JP); Yusuke Imahashi, Kanagawa (JP); Arihito Miyakoshi, Tokyo (JP); Yasushi Iijima, Tokyo (JP); Hideo Sugimura, Tokyo (JP); Takashi Horiba, Kanagawa (JP); Akira Fujikake, Kanagawa (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/113,890

(22) Filed: Dec. 7, 2020

(65) Prior Publication Data

US 2021/0170754 A1 Jun. 10, 2021

(30) Foreign Application Priority Data

Dec. 9, 2019 (JP) ..... JP2019-222265

(51) Int. Cl.
*B41J 2/165* (2006.01)
*B41J 2/17* (2006.01)

(52) U.S. Cl.
CPC ..... *B41J 2/1714* (2013.01); *B41J 2/16523* (2013.01); *B41J 2/16585* (2013.01)

(58) Field of Classification Search
None
See application file for complete search history.

(56) References Cited

U.S. PATENT DOCUMENTS

| | | | | |
|---|---|---|---|---|
| 9,381,746 | B2 | 7/2016 | Miyakoshi et al. | |
| 9,440,443 | B2 | 9/2016 | Arimizu et al. | |
| 2016/0271950 | A1* | 9/2016 | Imahashi | B41J 2/1714 |
| 2019/0009567 | A1* | 1/2019 | Miyakoshi | B41J 2/1714 |
| 2019/0173010 | A1* | 6/2019 | Lee | H01L 51/0005 |

FOREIGN PATENT DOCUMENTS

JP 2015-134496 A 7/2015

* cited by examiner

*Primary Examiner* — Alejandro Valencia
(74) *Attorney, Agent, or Firm* — Venable LLP

(57) ABSTRACT

A discharge apparatus includes a discharge unit configured to discharge a liquid to a medium, a suction unit, and a supply unit configured to supply a gas to the suction unit. The suction unit includes an opening facing the medium, and a suction groove including an arc-shaped inner wall surface inside the opening and configured to suck mist around the medium. An outlet portion configured to blow out the gas supplied from the supply unit toward the inner wall surface is provided in the opening.

19 Claims, 20 Drawing Sheets

DISCHARGE APPARATUS AND SUCTION UNIT

BACKGROUND OF THE INVENTION

Field of the Invention

The present invention relates to a discharge apparatus.

Description of the Related Art

In a printing apparatus that discharges ink to an intermediate transfer member or a medium such as a paper sheet to print an image, mist of minute ink components that do not land on the medium can be generated. Further, mist of evaporated ink components on the medium can also be generated. Such mist on the medium may adversely affect the printheads that discharge the ink. Therefore, an apparatus that sucks and collects the mist on the medium has been proposed (for example, Japanese Patent Laid-Open No. 2015-134496).

If the mist adheres to a passage for collecting the mist and mist particles grow, they may fall on the medium and stain the medium. The apparatus described in Japanese Patent Laid-Open No. 2015-134496 blows out air into the passage to suppress the adhesion of the mist to the collecting passage, but it has room for improvement.

SUMMARY OF THE INVENTION

The present invention provides a technique of suppressing adhesion of mist to a passage for collecting the mist.

According to one aspect of the present invention, there is provided a discharge apparatus comprising a discharge unit configured to discharge a liquid to a medium, a suction unit including: an opening facing the medium; and a suction groove including an arc-shaped inner wall surface inside the opening and configured to suck mist on the medium, and a supply unit configured to supply a gas to the suction unit, wherein the suction unit includes an outlet portion configured to blow out the gas supplied from the supply unit toward the inner wall surface in the opening.

Further features of the present invention will become apparent from the following description of exemplary embodiments (with reference to the attached drawings).

DESCRIPTION OF THE EMBODIMENTS

Figure 1:
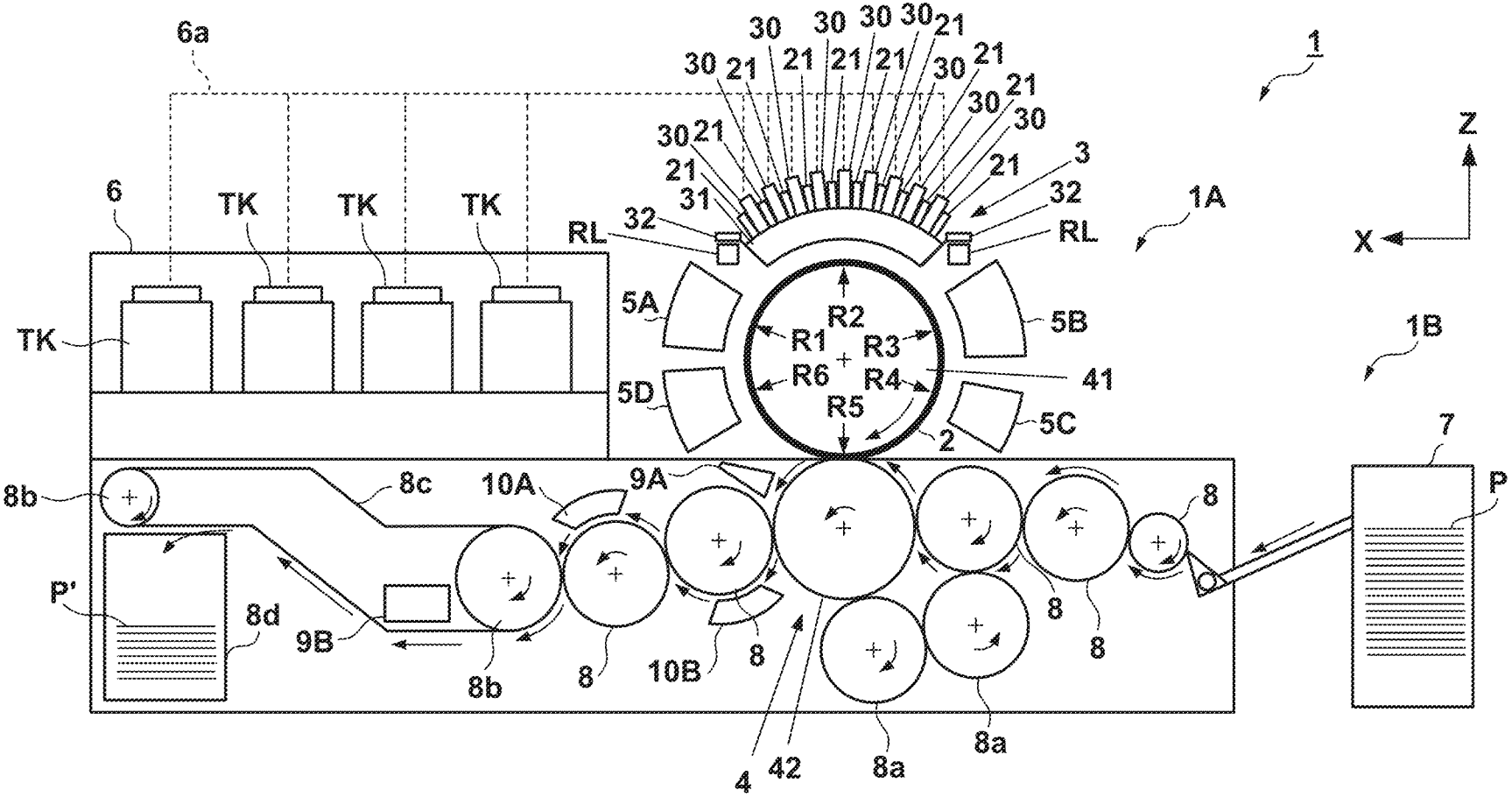
FIG. 1 is a schematic view showing a printing system.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

<Printing System>

FIG. 1 is a front view schematically showing a printing system (printing apparatus) 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction. Arrows X and Y indicate horizontal directions perpendicular to each other. An arrow Z indicates a vertical direction.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
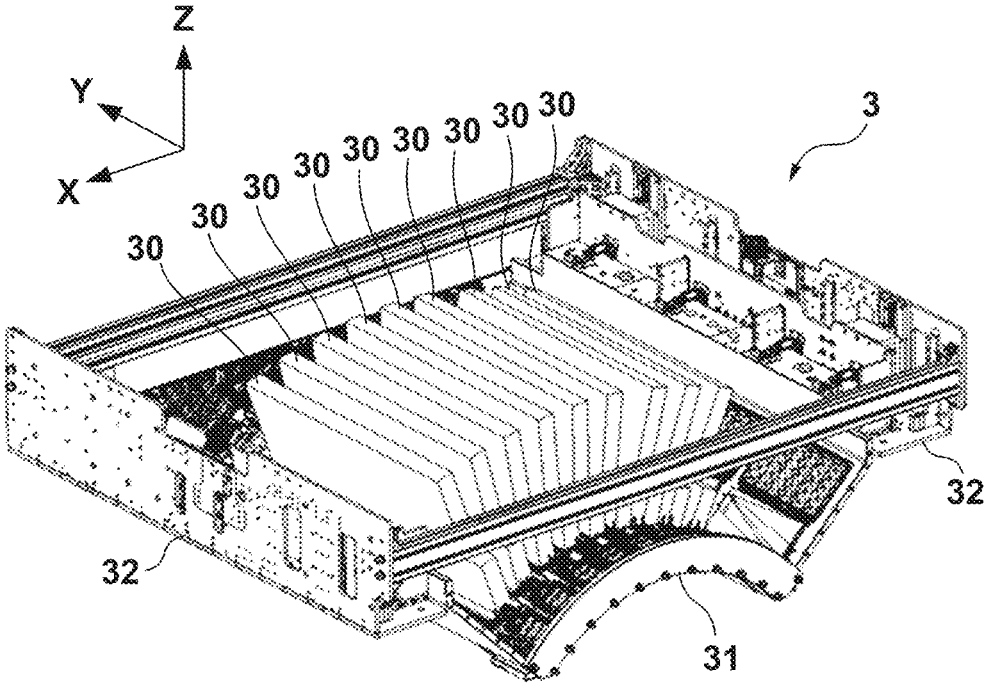
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to rotationally move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide unit RL. In this embodiment, the guide units RL are rail-like structures elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
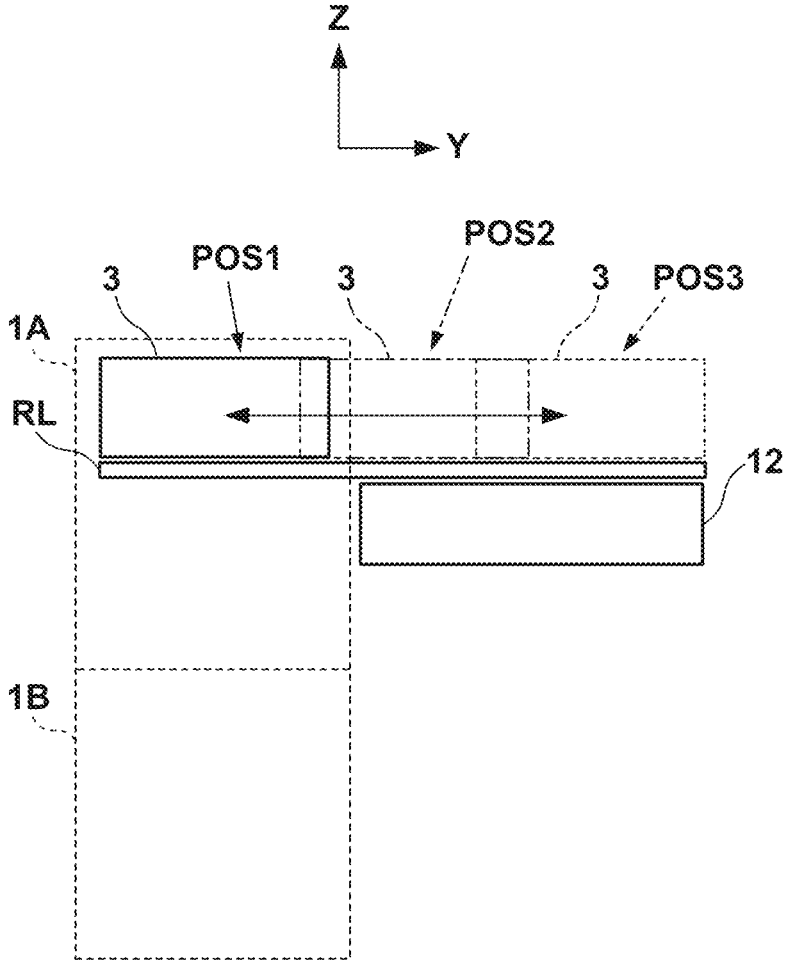
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide unit RL is elongated over the recovery unit 12 from the side of the transfer member 2. By the guide of the guide unit RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform performance recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise (counterclockwise).

The transfer drum 41 is a support member that supports the transfer member 2 on its outer peripheral surface. The surface of the transfer member 2 forms a transfer portion on which an ink image is to be formed. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 can share a driving source such as a motor that drives them, and a driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing include, for example, coating that aims at protection, glossiness, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images on every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
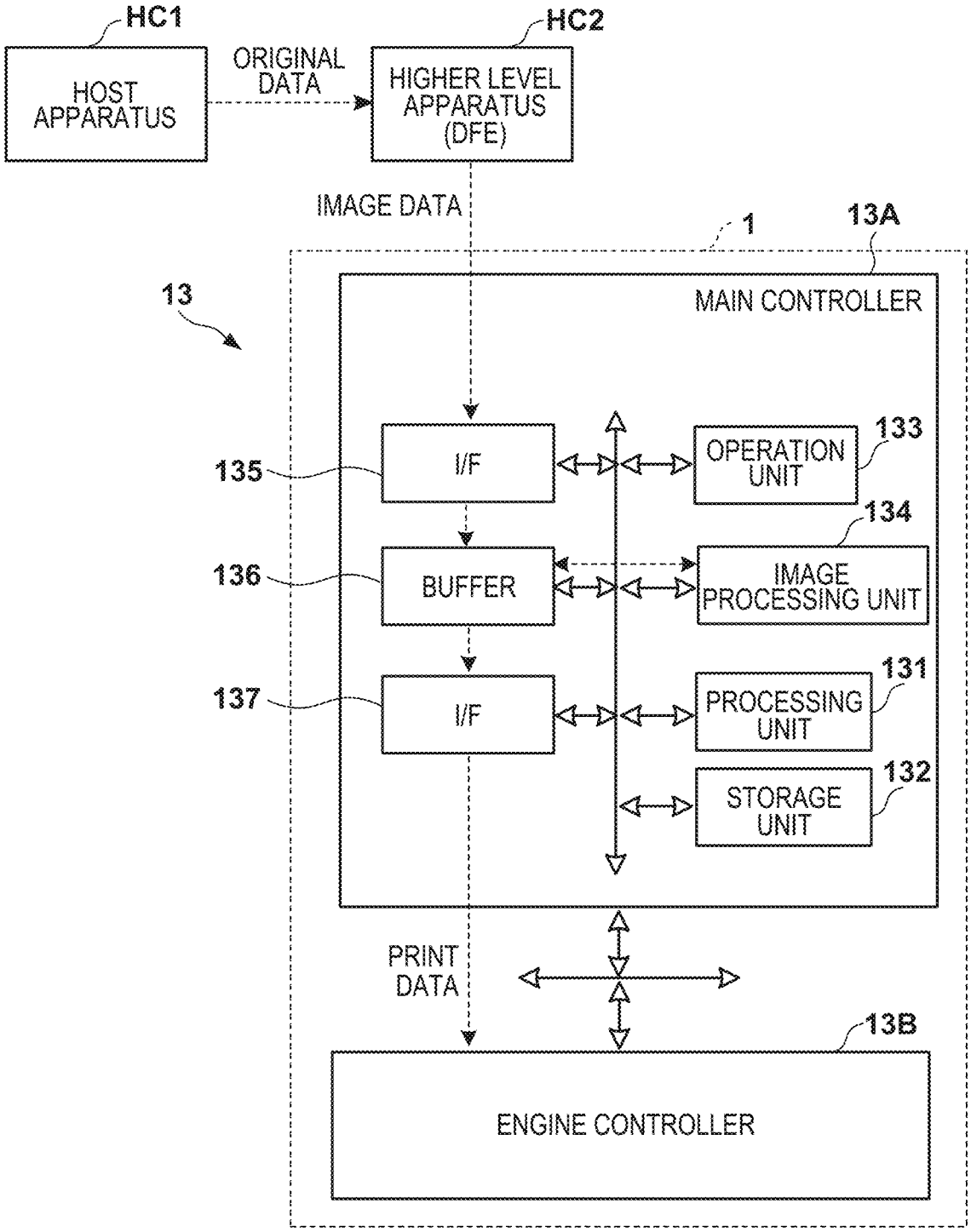
FIG. 4 is a block diagram showing a control system of the printing system in FIG. 1.
Figure 5:
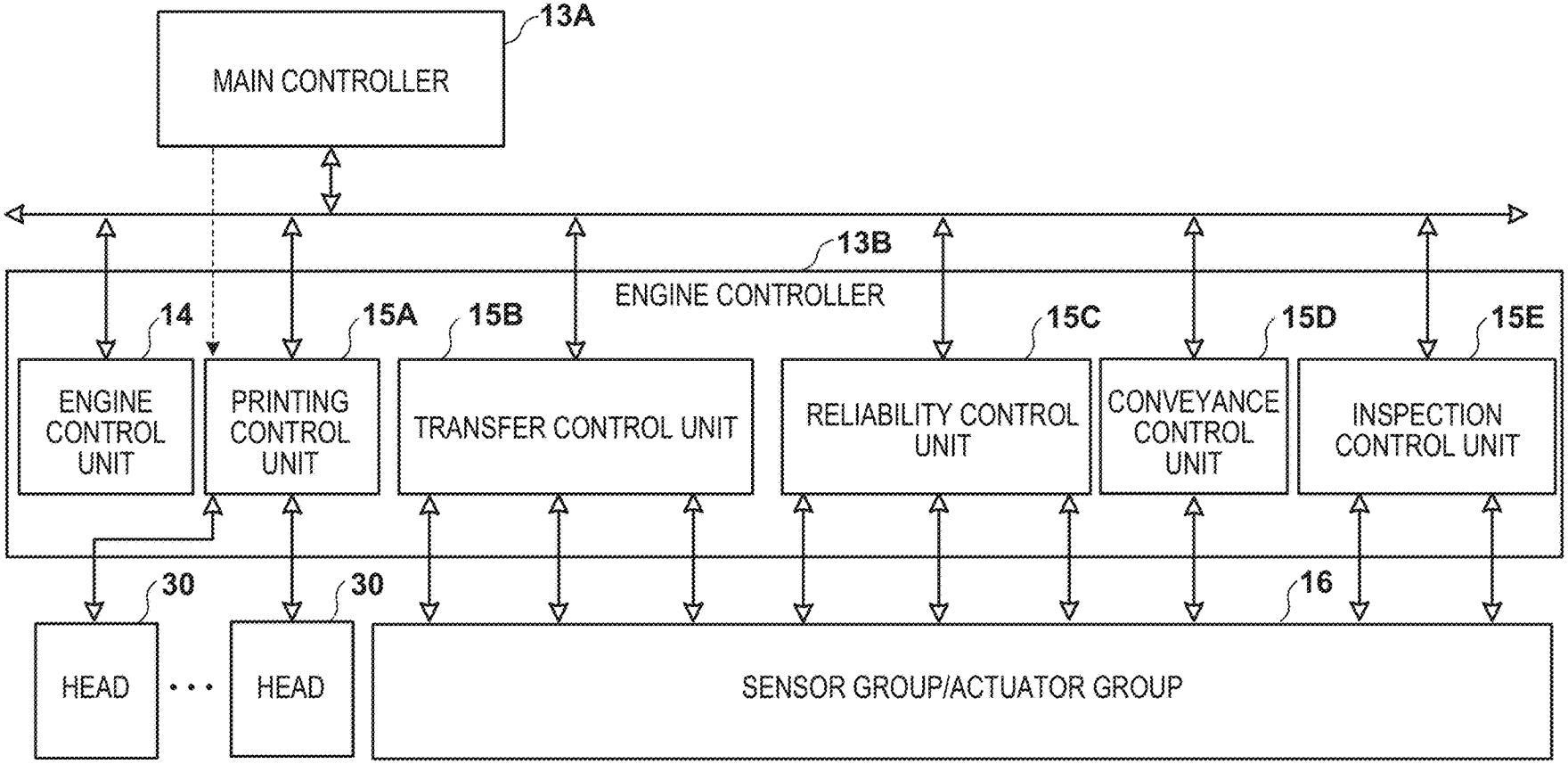
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

Operation Example

Figure 6:
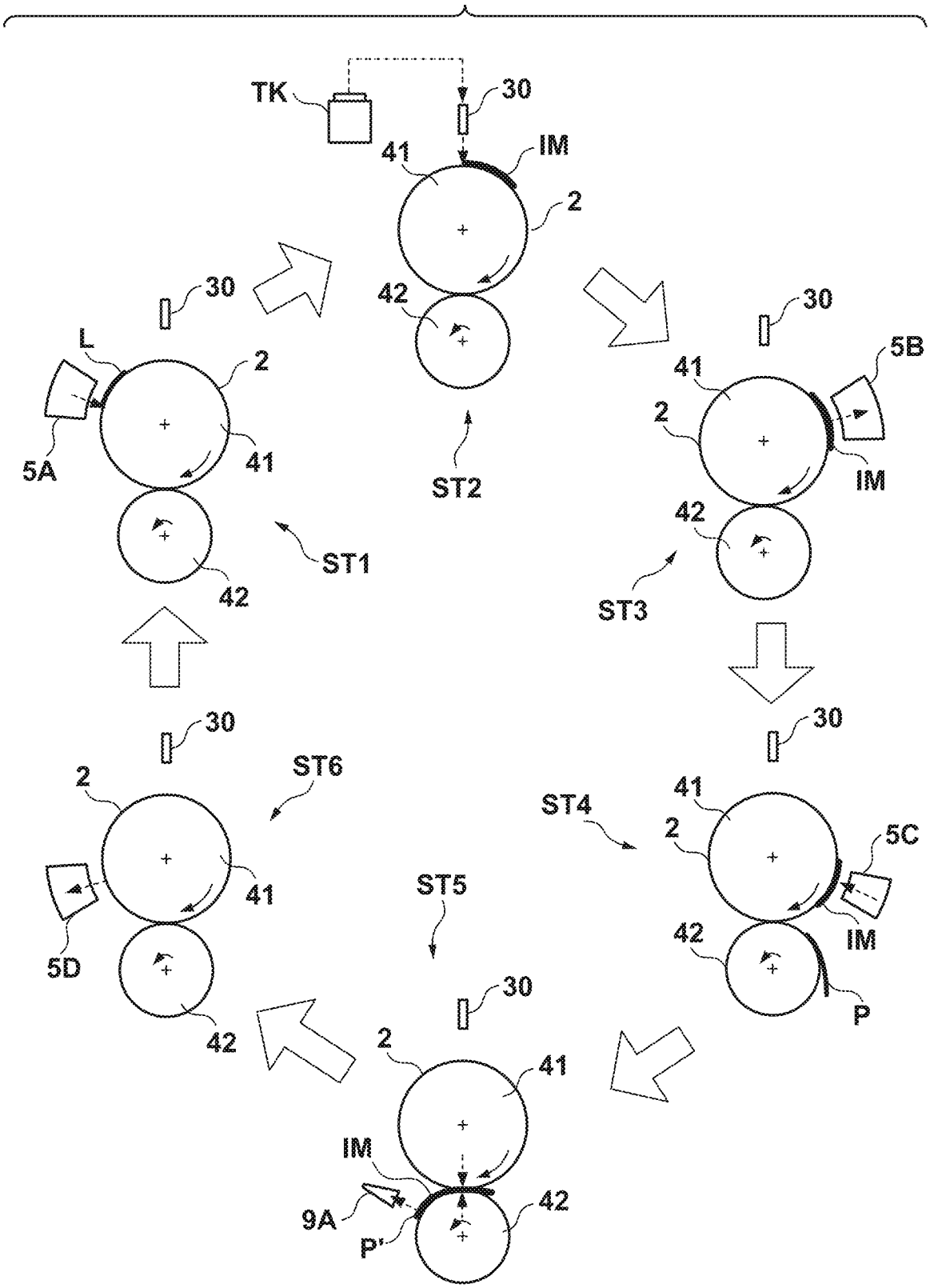
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image TM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Figure 7:
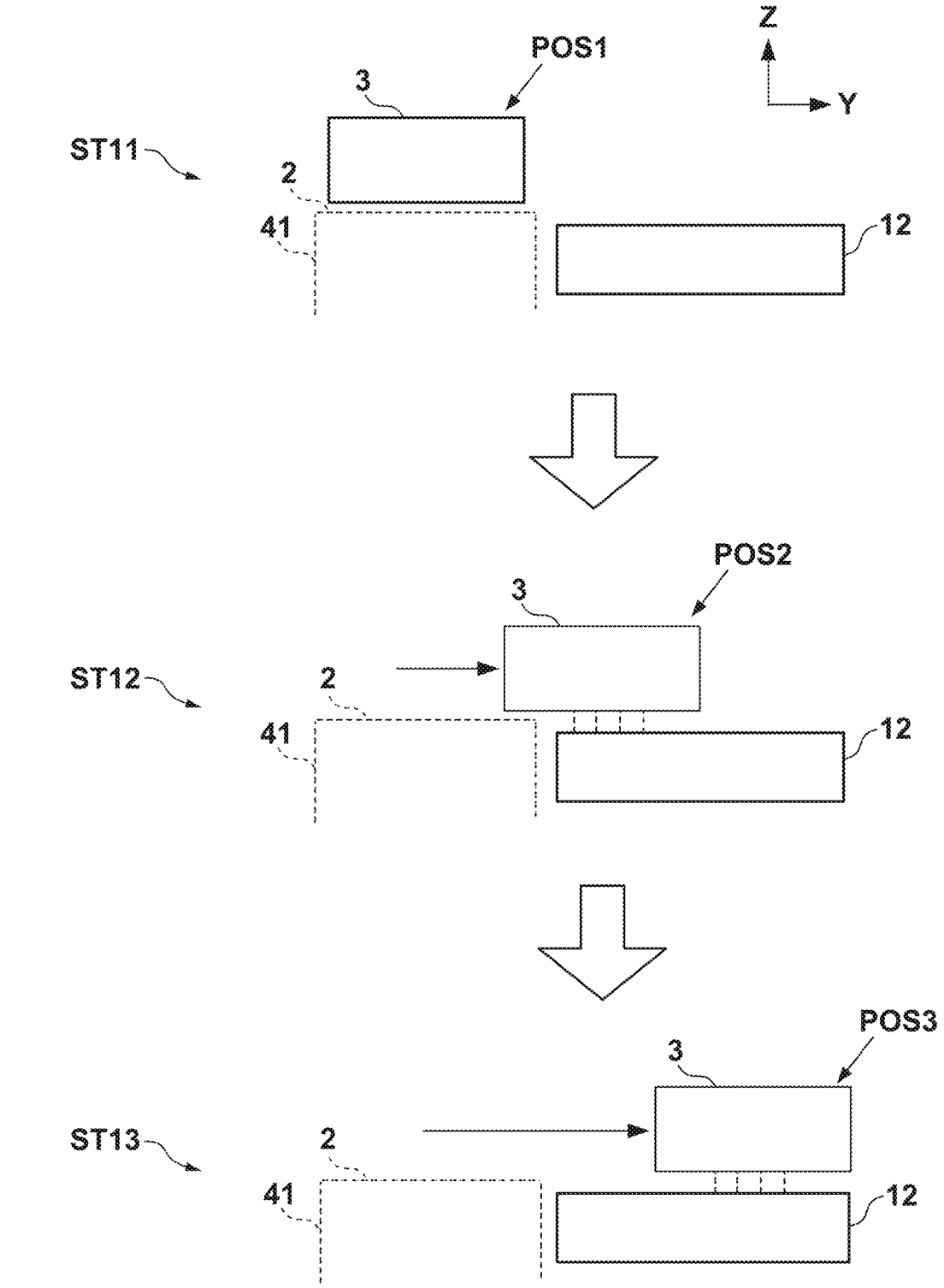
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

<Collecting Unit>

Figure 8:
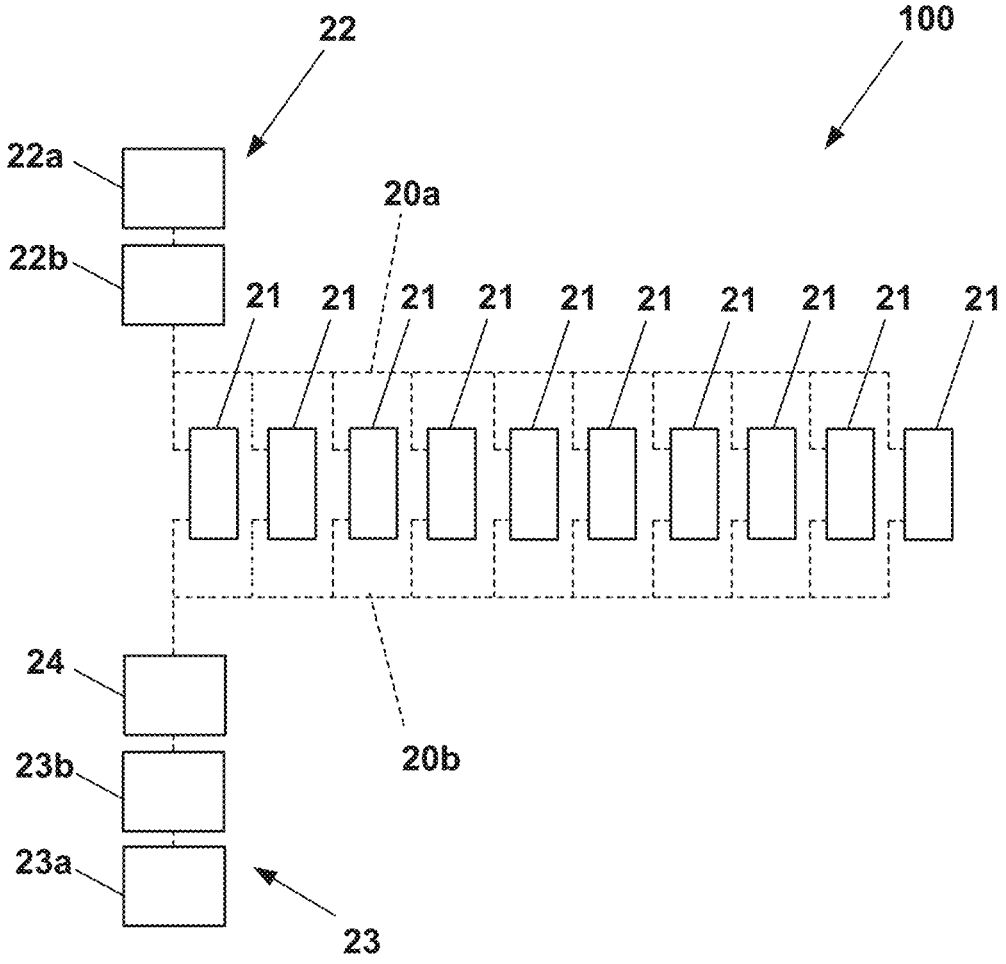
FIG. 8 is a block diagram showing a collecting unit.

Next, a mist collecting unit will be described. When the printheads 30 discharge ink to the transfer member 2, minute ink components (ink mist) that do not land on the transfer member 2 or water vapor generated by evaporation from the ink on the transfer member 2 may be flung up by the surrounding airflow. If a large amount of such mist adheres to the printheads 30, the ink discharge performance of the printheads 30 may be deteriorated. Therefore, the printing system 1 of this embodiment is provided with a collecting unit that collects mist on the transfer member 2 by sucking the mist. FIG. 8 is a block diagram showing a collecting unit 100.

The collecting unit 100 includes a plurality of suction heads 21, a supply unit 22 that supplies air to each suction head 21, an exhaust unit 23 that exhausts air from each suction head 21, and a filter 24.

The suction head 21 is a portion that sucks up the mist on the transfer member 2. FIG. 1 shows the arrangement of the respective suction heads 21. In this embodiment, the suction head 21 is arranged adjacent to the printhead 30 in the circumferential direction of the transfer drum 41. More specifically, the suction heads 21 are arranged between the adjacent printheads 30 and on the outer sides of the printheads 30 located at both ends in the circumferential direction of the transfer drum 41.

The supply unit 22 is a mechanism that supplies compressed air to the respective suction heads 21 via a pipe 20*a*. The supply unit 22 includes a pressure source 22*a* such as a pump and a flow rate adjusting valve 22*b* that adjusts the flow rate of air pumped from the pressure source 22*a*, and the pipe 20*a* is connected to the flow rate adjusting valve 22*b*. The flow rate adjusting valve 22*b* can adjust the pressure and amount of air blown out from the suction head 21.

The exhaust unit 23 is a mechanism that exhausts air (mist) from the respective suction heads 21 via a pipe 20*b*. The exhaust unit 23 includes a pressure source 23*a* such as a pump and a flow rate adjusting valve 23*b* that adjusts the flow rate of air exhausted by the pressure source 23*a*, and the pipe 20*b* is connected to the flow rate adjusting valve 23*b* via the filter 24. The flow rate adjusting valve 22*b* can adjust the pressure and amount of air sucked from the suction heads 21. The filter 24 is provided to remove mist in the air to be exhausted. The filter 24 prevents the mist in the air sucked and exhausted from the respective suction heads 21 via the pipe 20*b* from reaching the pressure source 23*a* and affecting the pressure source 23*a*.

For example, the printing control unit 15A controls driving of the supply unit 22 and the exhaust unit 23, and they are constantly driven during the printing operation.

Figure 9A:
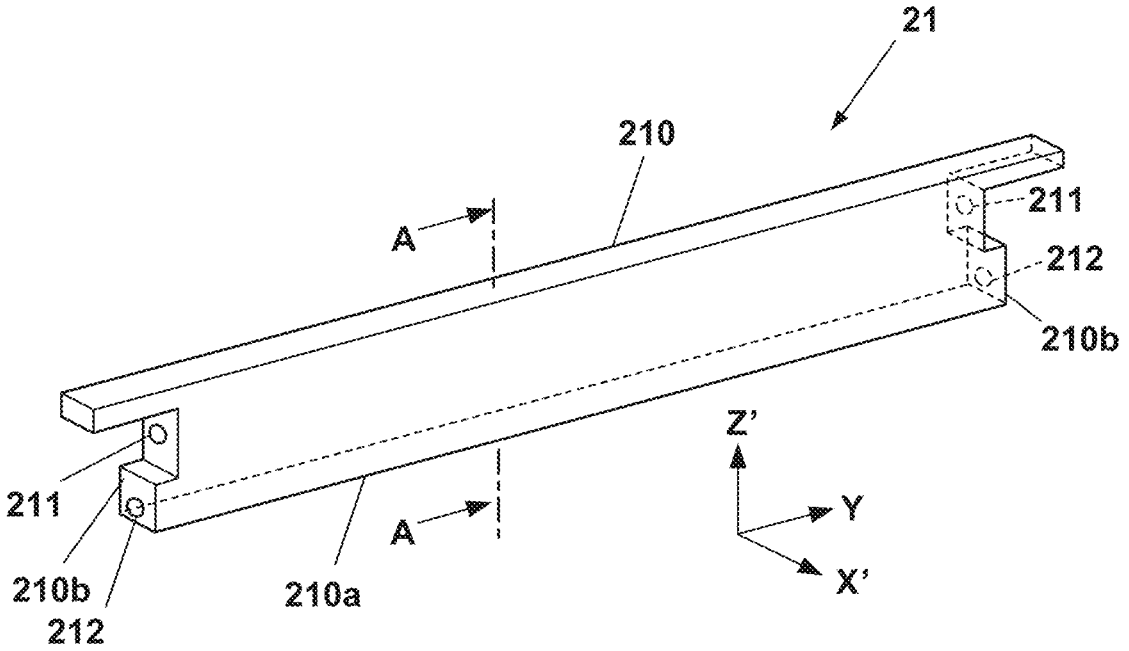
FIGS. 9A and 9B are a perspective view and a bottom view, respectively, of a suction head.
Figure 9B:
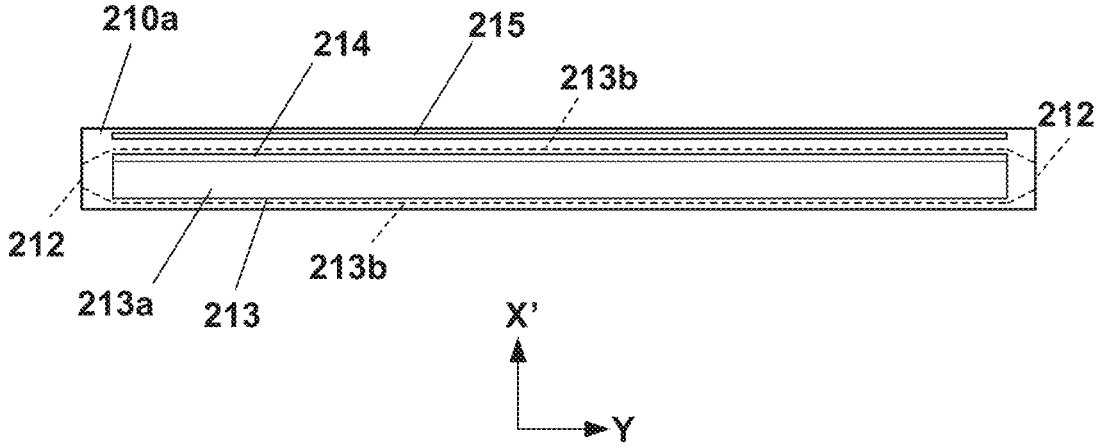

The details of the suction head 21 will be described. FIG. 9A is a perspective view of the suction head 21, and FIG. 9B is a bottom view of the suction head 21. In FIGS. 9A and 9B, an arrow X' indicates the circumferential direction of the transfer drum 41 and the moving direction of the transfer member 2. In the moving direction of the transfer member 2, the destination side (the direction indicated by the arrow) may be referred to as the downstream side, and the opposite side may be referred to as the upstream side. An arrow Z' indicates the outer direction in the radial direction of the transfer drum 41.

The suction head 21 includes a hollow main body 210. The main body 210 is a long piece-shaped member having an almost rectangular parallelepiped outer shape and extending in a direction intersecting the X' direction (the Y direction which is the direction orthogonal to the X' direction in this embodiment). The main body 210 includes a bottom surface 210*a* facing the transfer member 2 and Y-direction end portions 210*b*. At each end portion 210*b*, an introduction section 211 to which the pipe 20*a* is connected and the air from the supply unit 22 is introduced and an exhaust section 212 to which the pipe 20*b* is connected are formed so as to be separated from each other in the Z' direction. Each of both end portions 210*b* of the main body 210 is provided with the introduction section 211 and the exhaust section 212 in this embodiment, but only one of the end portions 210*b* may be provided with the introduction section 211 and the exhaust section 212. Alternatively, one end portion 210*b* may be provided with the introduction section 211 and the other end portion 210*b* may be provided with the exhaust section 212.

The main body 210 includes a suction groove 213. The suction groove 213 includes an opening portion 213*a* that is open in the bottom surface 210*a*. In other words, the opening portion 213*a* is open facing the transfer member 2. The suction groove 213 is extended in the direction intersecting the X' direction (the Y direction in this embodiment), and the length in the extending direction is equal to or larger than the width of the transfer member 2 in the Y direction. In other words, the suction groove 213 has the length that covers the entire area of the transfer member 2 in the Y direction, or covers the entire printing area of the printhead 30 in the Y direction. The suction groove 213 is a single groove in this embodiment, but it may be divided into a plurality of grooves in the Y direction.

The suction groove 213 communicates with the exhaust section 212 at each end portion in the Y direction. When the exhaust unit 23 sucks and exhausts air via the exhaust section 212, mist on and around the transfer member 2 is sucked from the opening portion 213*a* into the suction groove 213, and exhausted from the suction groove 213 via the exhaust section 212. Note that the end portion of the suction groove 213 communicates with the exhaust section 212 in this embodiment, but the exhaust section 212 may be configured to communicate with the suction groove 213 at the intermediate portion of the suction groove 213 in the Y direction.

A nozzle 214 including an output portion 214*a*, which will be described later, is provided in one edge of the suction groove 213 in the X' direction. An outlet portion 215 is formed in the bottom surface 210*a*. The nozzle 214 (and the outlet portion 214*a*) and the outlet portion 215 are extended in the Y direction, and their extending lengths are equal to that of the suction groove 213. Each of the outlet portion 214*a* and the outlet portion 215 in this embodiment is a single opening extended in the Y direction, but they may be a plurality of openings arranged in the Y direction.

Figure 10:
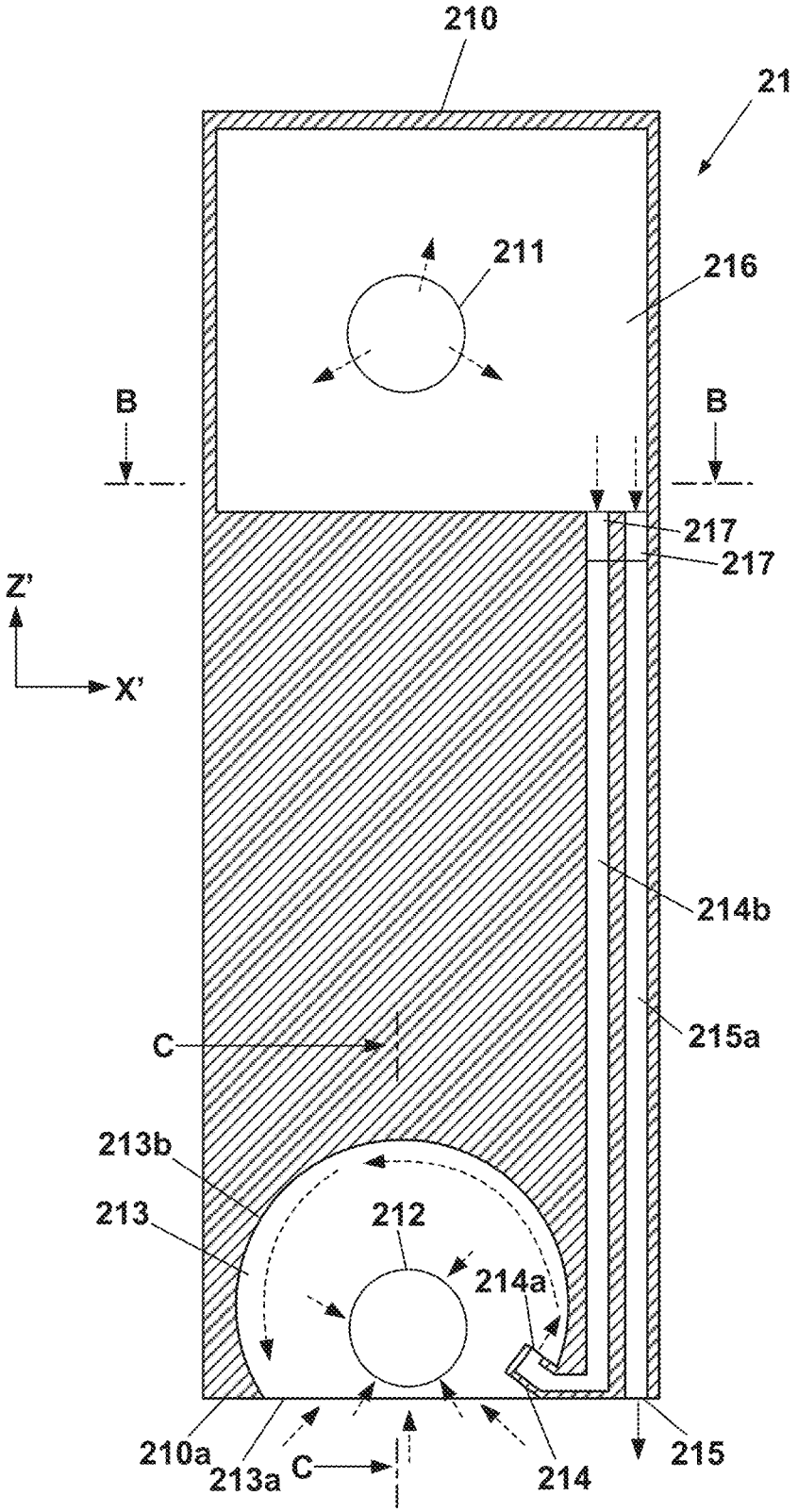
FIG. 10 is a sectional view taken along a line A-A in FIG. 9A.
Figure 11:
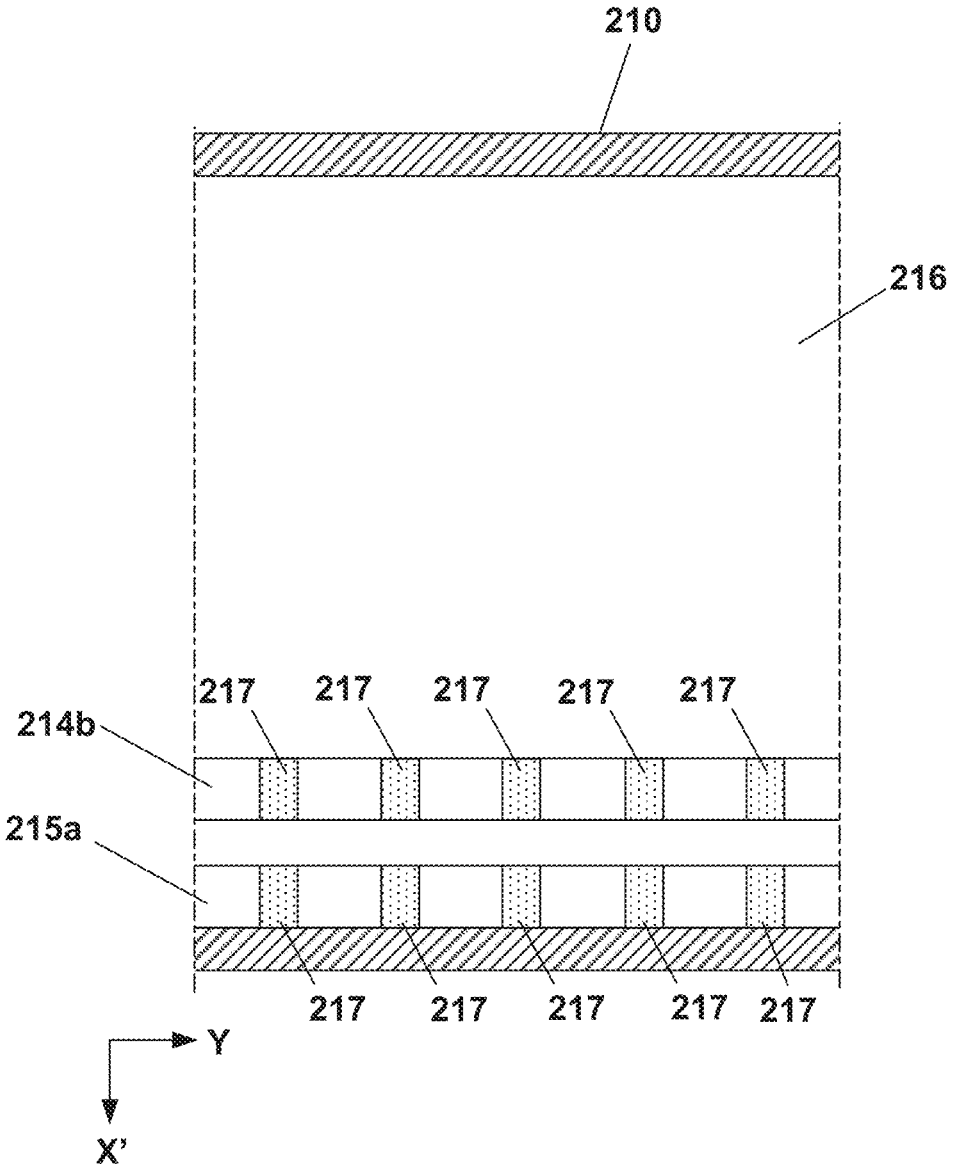
FIG. 11 is a sectional view taken along a line B-B in FIG. 10.
Figure 12:
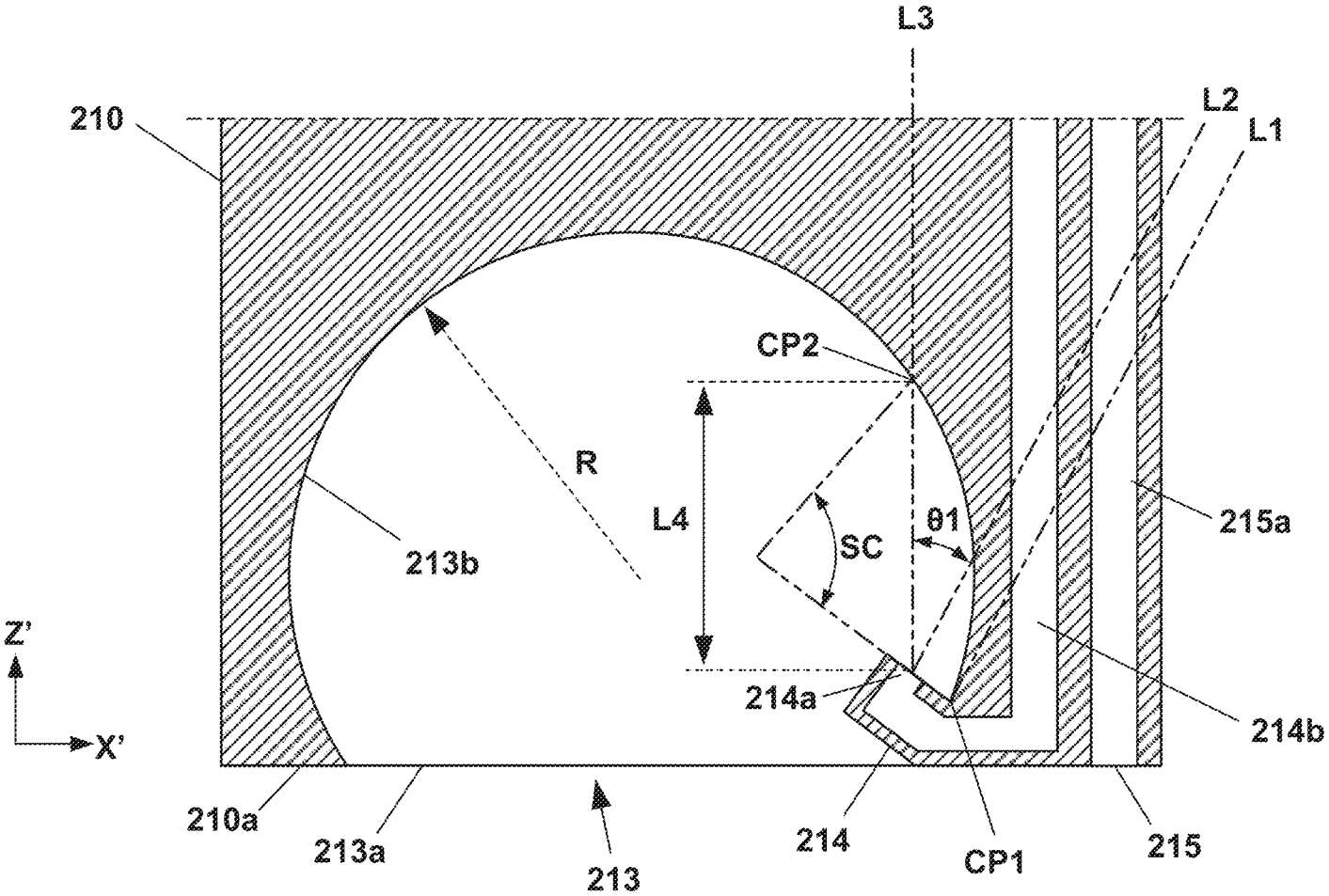
FIG. 12 is a partially enlarged view of FIG. 10.

With reference also to FIGS. 10 to 12, the structure of the suction head 21 will be further described. FIG. 10 is a sectional view taken along a line A-A in FIG. 9A, and dashed arrows in FIG. 10 schematically show the flow of air. FIG. 11 is a sectional view taken along a line B-B in FIG. 10. FIG. 12 is a partially enlarged view of FIG. 10, and the portion of the suction groove 213 is enlarged and shown.

The suction groove 213 is formed in one end portion (on the transfer member 2 side) of the main body 210 in the Z' direction, and a pressure chamber (pressure buffer chamber) 216 is formed in the other end portion (on the opposite side in the Z' direction).

The pressure chamber 216 is an internal space of the main body 210 extended in the Y direction, and communicates with the introduction sections 211 at both end portions in the Y direction. The outlet portion 214*a* communicates with the pressure chamber 216 via a passage 214*b*, and the outlet portion 215 communicates with the pressure chamber 216 via a passage 215*a*. Each of the passages 214*b* and 215*a* is a thin parallelepiped passage extending from the pressure chamber 216 to the bottom surface 210*a* side and extending in the Y direction. The outlet portion 214*a* is a hole opened in the end portion of the nozzle 214, and the outlet portion 215 is a hole opened in the bottom surface 210*a*. Each of the outlet portion 214*a* and the outlet portion 215 in this embodiment is a single slit-shaped or slot-shaped hole extended in the Y direction, but they may be a plurality of holes arranged in the Y direction.

The air pumped from the supply unit 22 is first introduced to the pressure chamber 216. The air introduced to the pressure chamber 216 passes through the passage 214*b* and is blown into the suction groove 213 from the outlet portion 214*a* of the nozzle 214. Further, the air introduced to the pressure chamber 216 passes through the passage 215*a* and is blown out from the outlet portion 215 to the transfer member 2. In this embodiment, since the air is blown out from the outlet portion 215 to the transfer member 2 at a portion downstream of the suction groove 213 in the X' direction, it is possible to urge the mist on the transfer member 2 to the suction groove 213 and prevent the mist from flowing to the downstream side in the X' direction. Note that the outlet direction of the outlet portion 215 is a direction orthogonal to the X' direction in this embodiment, but it may be a direction not orthogonal to the X' direction, and it need only be a direction intersecting the X' direction.

In the end portions of the passage 214*b* and the passage 215*a* on the pressure chamber 216 side, a plurality of passage closing portions 217 are provided as pressure adjusting portions that uniformize the Y-direction pressure distribution of the air blown out from the outlet portion 214*a* and the outlet portion 215. The plurality of passage closing portions 217 are arranged in a comb-tooth shape in the Y direction, and partially close the passage 214*b* and the passage 215*a*. In the end portions of the passage 214*b* and the passage 215*a* on the pressure chamber 216 side, a plurality of slots arranged in the Y direction are formed by the passage closing portions 217. Therefore, it is possible to prevent the air entering the passage 214*b* or the passage 215*a* from the pressure chamber 216 from being biased to a specific portion in the Y direction.

In this embodiment, the suction groove 213 is a bottomed groove in which an inner wall surface 213*b* is formed from one edge of the opening portion 213*a* in the X' direction to the other edge. Particularly in this embodiment, the suction groove 213 is a bag-shaped groove in which the width inside the suction groove 213 is larger than the width of the opening portion 213*a* in the X' direction. In this embodiment, the sectional shape of the inner wall surface 213*b* (in other words, the sectional contour shape) has an arc shape having a radius R. However, the shape may be another arc shape such as an elliptical arc shape. It is advantageous if the sectional shape of the inner wall surface 213*b* is entirely the arc shape in relation to generation of a swirling flow to be described later, but the sectional shape may be at least partially the arc shape, or may be a polygonal shape.

The air outlet direction of the outlet portion 214*a* is directed to the inner wall surface 213*b*. This can generate a swirling flow along the inner wall surface 213*b* in the suction groove 213, so that it is possible to suppress adhesion, to the inner wall surface 213*b*, of ink or the like contained in the sucked mist. Particularly, it is possible to suppress the adhesion near the entrance of the suction groove 213 where the ink or the like easily adheres. Since the outlet portion 214*a* is located in one edge of the opening portion 213*a* in the X' direction, the blown air flows a longer distance along the inner wall surface 213*b*, so that it is possible to more securely generate the swirling flow. Further, since the outlet portion 214*a* is formed in a portion opposite to the portion of the nozzle 214 facing the transfer member 2, the other portion of the nozzle 214 serves as a wall, so that it is possible to prevent the mist or the like from adhering to the outlet portion 214*a*.

With reference FIG. 12, a design example of the outlet direction of the outlet portion 214*a* will be described more specifically. A crossing line CP1 (a point in FIG. 12) is an end edge of the inner wall surface 213*b*. A virtual plane L1 is a tangent plane (a tangent line in FIG. 12) of the inner wall surface 213*b* at the crossing line CP1. A virtual plane L2 is a plane passing through the center of the outlet portion 214*a* in parallel with the virtual plane L1. A virtual plane L3 is a plane passing through the center of the outlet portion 214*a* and inclined by an angle θ1 with respect to the virtual plane L2. A crossing line CP2 (a point in FIG. 12) is a crossing line between the virtual plane L3 and the inner wall surface 213*b*.

The air blown out from the outlet portion 214*a* comes into contact with the inner wall surface 213*b* since it is directed to the inner wall surface 213*b*, but the smaller contact range is advantageous in terms of generation of the swirling flow. In the example shown in FIG. 12, the air blown out from the outlet portion 214*a* comes into contact with the inner wall surface 213*b* in a section SC from the crossing line CP1 to the crossing line CP2. The angle θ1 is equal to or smaller than 45°, or equal to or smaller than 30°, for example. Further, if the distance from the center of the outlet portion 214*a* to the crossing line CP2 on the plane L3 is L4, $L4<\sqrt{(2\times R)}$ holds.

Figure 13A:
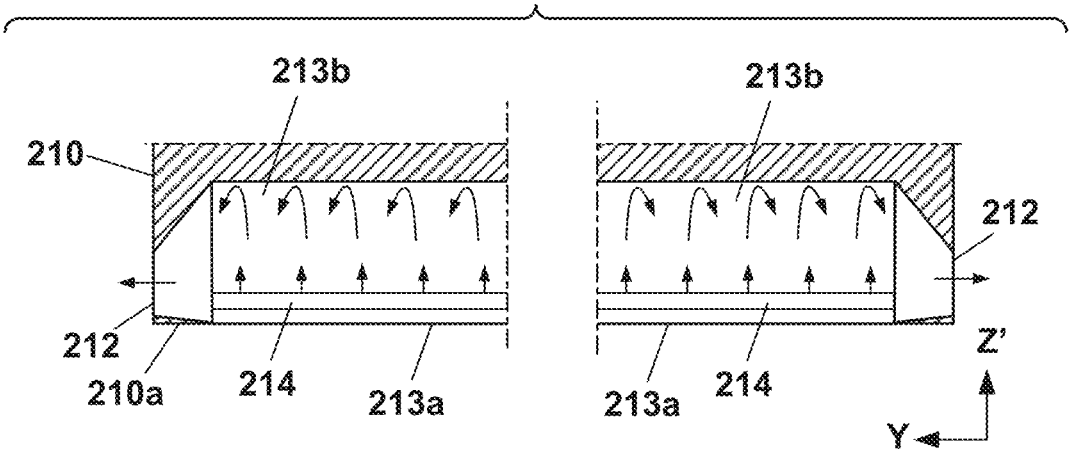
FIG. 13A is a sectional view taken along a line C-C in FIG. 10.

The effect of the suction head 21 having the arrangement described above will be described. First, since air is blown out from the outlet portion 215, air containing mist is prevented from flowing to the downstream side in the X' direction. The airflow blown out from the outlet portion 215 causes the air containing mist to be sucked into the suction groove 213 and exhausted from the exhaust section 212. FIG. 13A is a sectional view taken along a line C-C in FIG. 10, in which solid arrows schematically indicate the direction of airflow. The air blown out from the outlet portion 214*a* of the nozzle 214 swirls along the inner wall surface 213*b* (Coanda effect), and forms a film-like or layered flow of air on the inner wall surface 213*b*. This prevents the air containing mist sucked from the opening portion 213*a* into the suction groove 213 from coming into contact with the inner wall surface 213*b*. This can prevent the inner wall surface 213*b* from being contaminated with the mist, and reduce the maintenance frequency. A spiral swirling flow toward the exhaust section 212 is formed inside the suction groove 213, and the air containing mist is exhausted from the exhaust section 212.

Figure 13B:
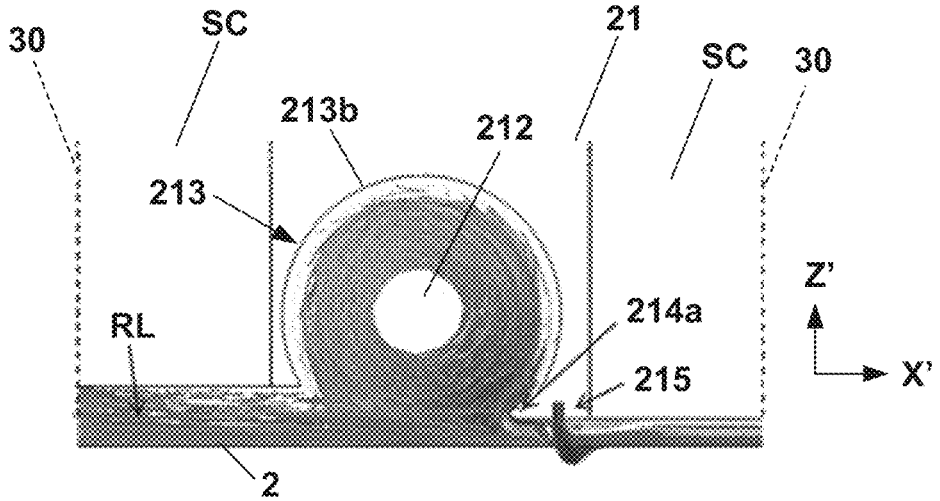
FIGS. 13B and 13C are views showing a simulation result of an airflow.
Figure 13C:
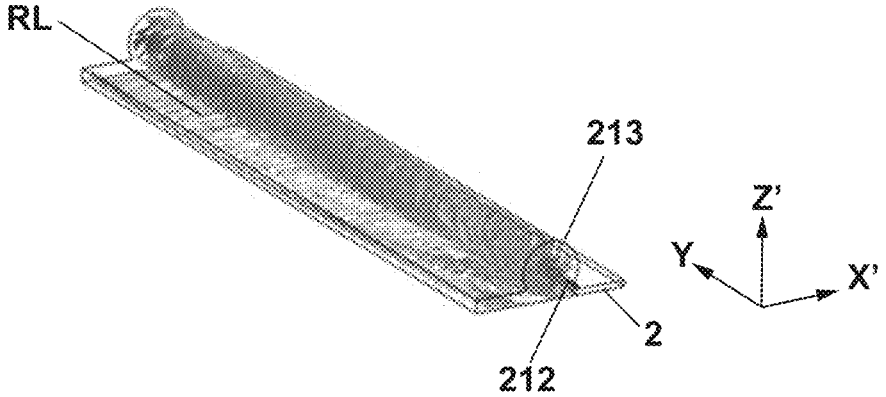
Figure 14:
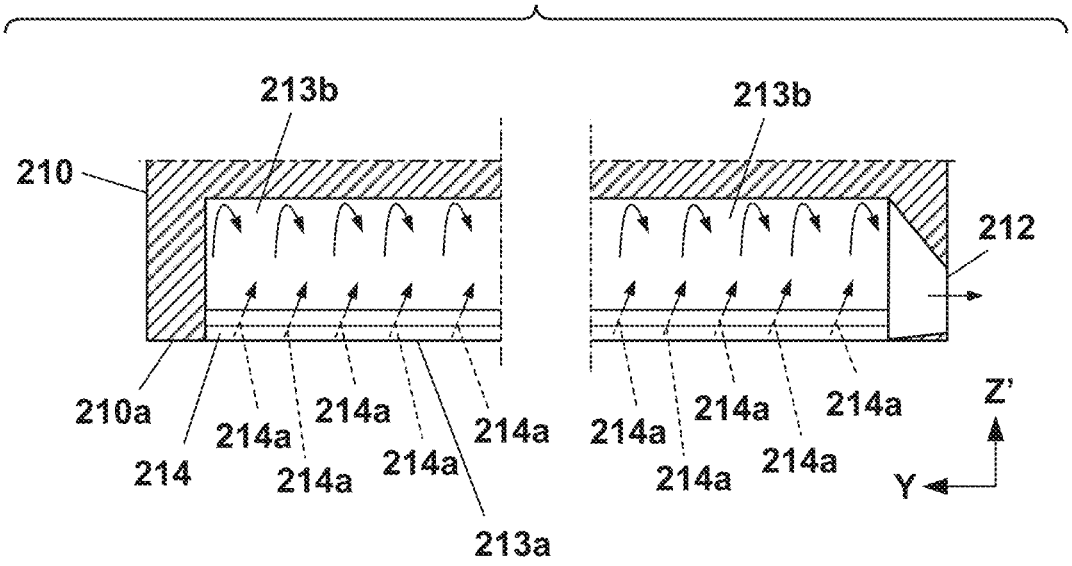
FIG. 14 is an explanatory view showing conditions of the simulation.

FIGS. 13B and 13C show an example of a simulation of an airflow (line of flow) RL of the mist around the suction groove 213. In the illustrated example, a spacer SC is inserted between the printhead 30 and the suction head 21. The spacer SC can be omitted. FIG. 14 is a view schematically showing the state of the airflow inside the suction groove 213 in the simulation, and corresponds to a sectional view taken along the line C-C in FIG. 10. In the illustrated example, the exhaust section 212 is provided only in one end portion of the main body 210 in the Y direction.

Further, the outlet portion 214*a* includes a plurality of holes (indicated by dashed lines) arranged in the Y direction, and the outlet direction is inclined in the Y direction. In this manner, the outlet direction may be inclined in the Y direction and, in this case, the outlet direction may be inclined so as to be directed to the exhaust section 212 side as in the illustrated example. In the arrangement in which the exhaust sections 212 are provided in both end portions of the main body 210 in the Y direction, the outlet direction may be inclined so as to be directed to the side of the exhaust section 212, of the two exhaust sections 212, closer to the outlet portion 214*a*. Note that even when the outlet portion 214*a* is formed as a single opening extending in the Y direction as in the example shown in FIG. 9B, the outlet direction can be inclined in the Y direction by providing a straightening plate inside.

The flow velocity of the air blown out from each hole of the outlet portion 214*a* is 1.0 m/s for the X'-direction component, 1.0 m/s for the Z'-direction component, and 0.3 m/s for the Y-direction component. The width of the outlet portion 215 in the X' direction is 0.5 mm, and the flow velocity of the blown air is 2.0 m/s. It can be seen from FIGS. 13B and 13C that the line of flow RL of the mist forms the spiral swirling flow toward the exhaust section 212 inside the suction groove. Further, it can be seen that the mist flows apart from the inner wall surface 213*b*.

As has been described above, this embodiment can provide a technique of suppressing adhesion of mist to the passage for collecting the mist, particularly, to the suction groove 213. The number of air passages in the suction head 21 is relatively small, and this contributes to its manufacturing merit and reduction of the required amount of air. When cleaning the inside of the suction head 21 as maintenance, the cleaning is easy since the suction groove 213 is open. Further, it is also possible to inject a cleaning solution from the introduction section 211 to the inside of the suction head 21 for cleaning, and it is also easy to clean the pressure chamber 216 and the passages 214*b* and 215*a*.

Other Examples of Suction Head

Other arrangement examples of the suction head 21 will be described. The arrangement example described above may be appropriately combined with each arrangement example to be described below.

Arrangement Example 1

Figure 15:
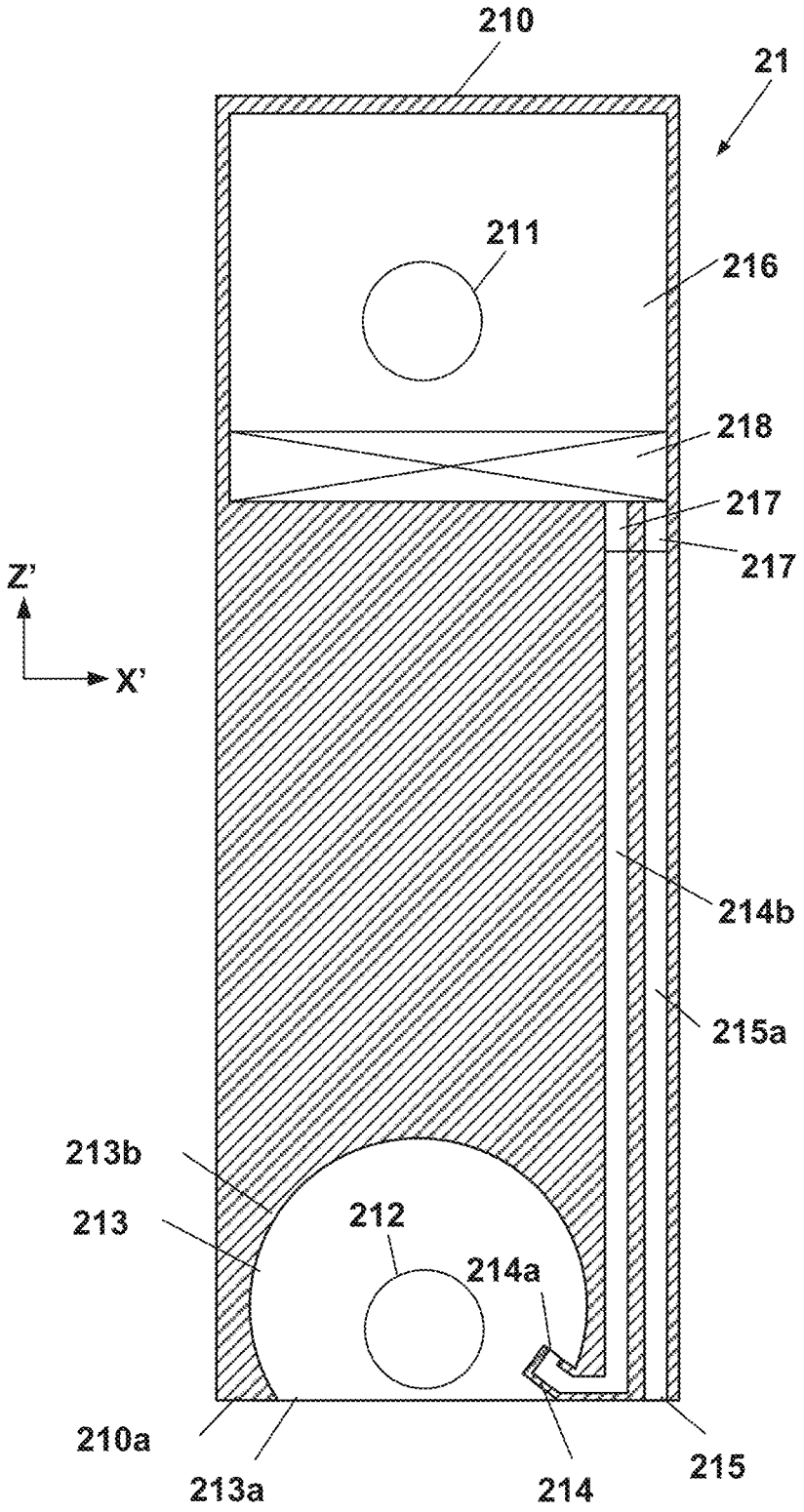
FIG. 15 is a sectional view showing another example of the suction head.

A porous body may be provided as the pressure adjusting portion between the pressure chamber 216 and the outlet portions 214*a* and 215. FIG. 15 shows an example of this arrangement, and corresponds to a sectional view taken along the line A-A in FIG. 9A. A porous body 218 is a plate-like member extending in the Y direction and arranged in the pressure chamber 216. The porous body 218 is interposed between the introduction section 211 and the end portions of the passage 214*b* and the passage 215*a*.

The porous body 218 is, for example, a plate (for example, a honeycomb plate) including a large number of holes or a laminated body of fibers. The porous body 218 can promote uniformization of the Y-direction pressure distribution of air in the pressure chamber 216. Therefore, the Y-direction pressure distribution of the air blown out from the outlet portion 214*a* and the outlet portion 215 can be uniformized.

In the example shown in FIG. 15, the porous body 218 and the passage closing portions 217 are used in combination, but only one of them may be provided.

Arrangement Example 2

Figure 16:
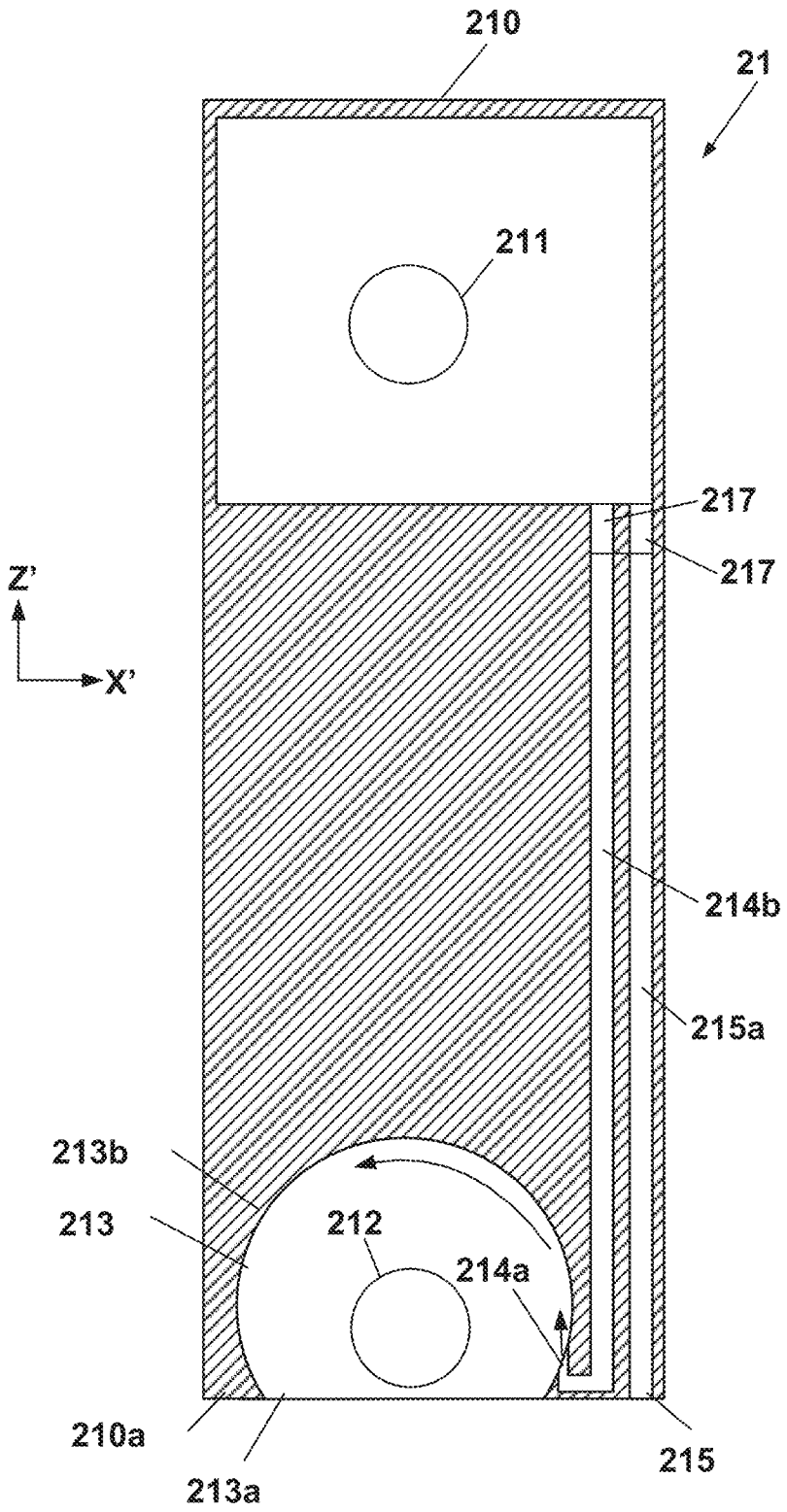
FIG. 16 is a sectional view showing still another example of the suction head.

In the example shown in FIG. 10, the nozzle 214 for forming the outlet portion 214*a* is provided. However, the outlet portion 214*a* may be formed in the inner wall surface 213*b* without providing the nozzle 214. FIG. 16 is a view showing an example of this arrangement, and corresponds to a sectional view taken along the line A-A in FIG. 9A. In the illustrated example, a slit-shaped hole communicating with the passage 214*b* and extending in the Y direction is formed in the inner wall surface 213*b* and used as the outlet portion 214*a*. In such an arrangement, it is also possible to form a swirling flow in the suction groove 213.

Arrangement Example 3

Figure 17:
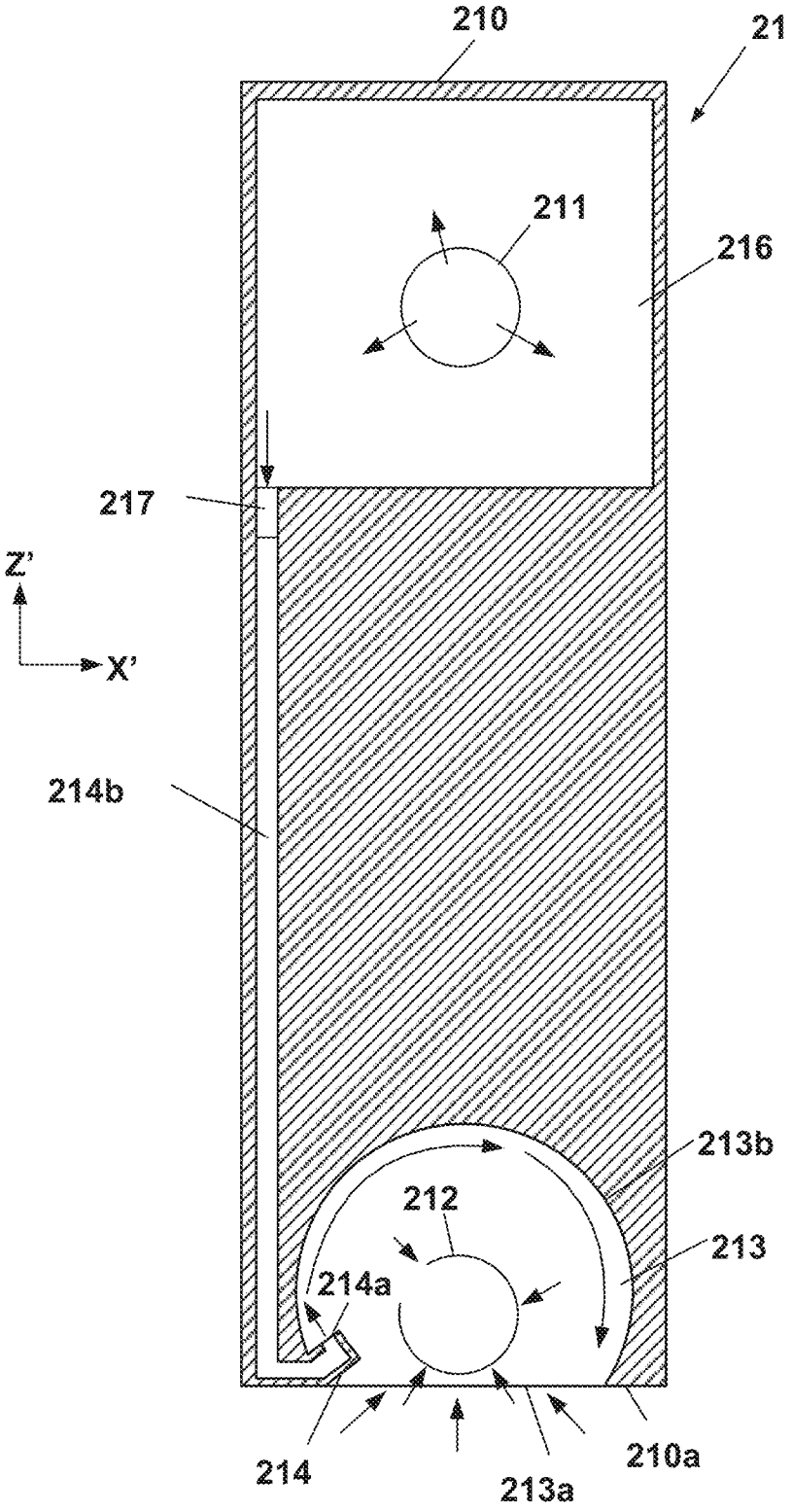
FIG. 17 is a sectional view showing still another example of the suction head.

In the example shown in FIG. 10, the outlet portion 214*a* is arranged in the edge on the downstream side of the edges of the opening portion 213*a* in the X' direction, but the outlet portion 214*a* may be arranged in the edge on the upstream side. FIG. 17 shows an example of this arrangement. In the illustrated example, the nozzle 214 is arranged in the edge on the upstream side of the edges of the opening portion 213*a* in the X' direction, and the outlet portion 214*a* is provided in the nozzle 214. The direction of the swirling flow is opposite to that in the example shown in FIG. 10.

In the example shown in FIG. 17, the swirling flow generated in the suction groove 213 sucks the flow of air containing mist flowing from the upstream side in the X' direction so as to draw it into the suction groove 213. Therefore, it is possible to suppress that the air containing mist flowing from the upstream side in the X' direction flows to the downstream side.

Figure 18:
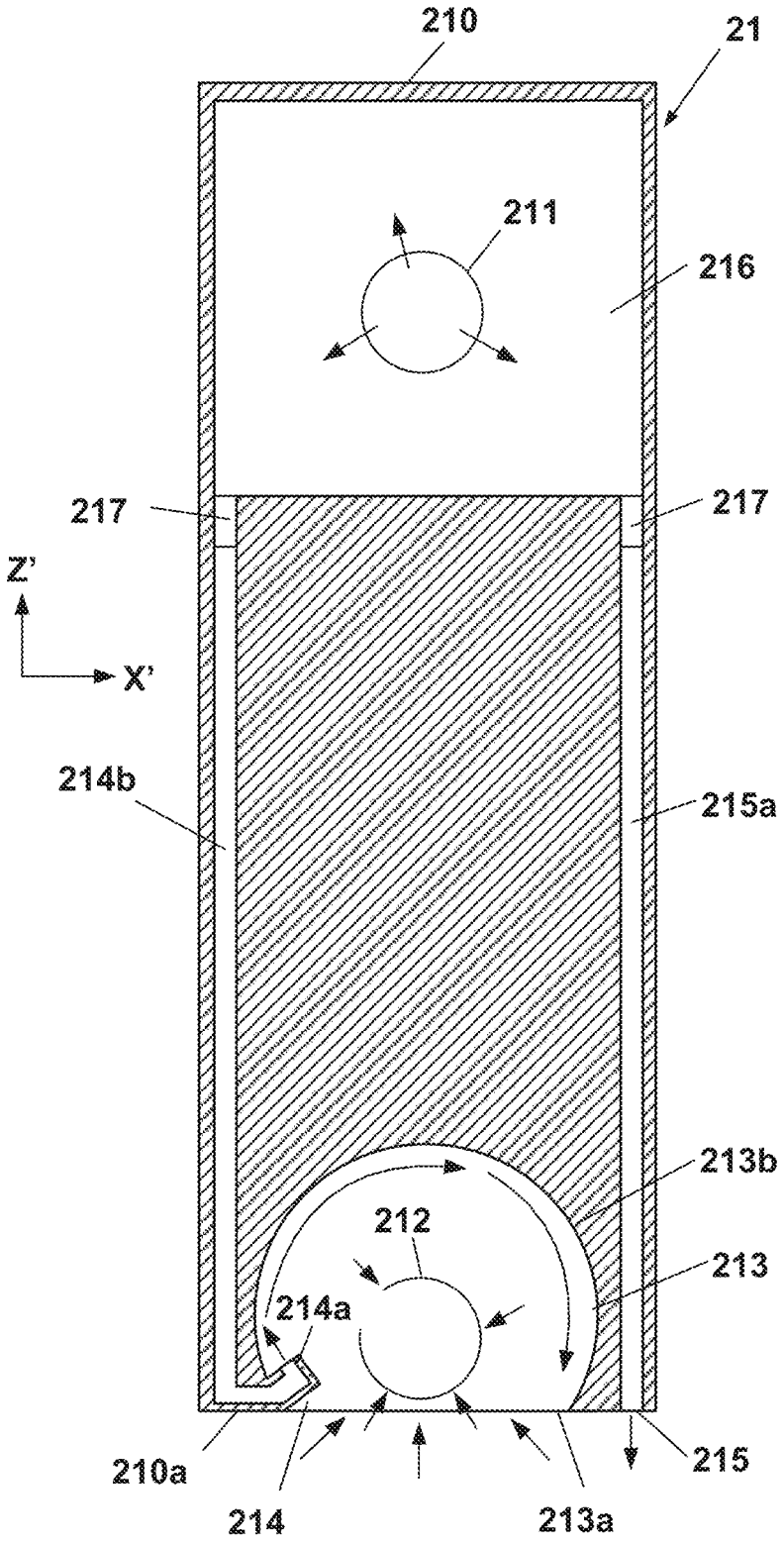
FIG. 18 is a sectional view showing still another example of the suction head.

In the example shown in FIG. 17, it is possible to omit the outlet portion 215 and the passage 215*a* in the example shown in FIG. 10. However, the outlet portion 215 and the passage 215*a* may be provided as in an example shown in FIG. 18. With this arrangement, it is possible to further suppress that the flow of air containing mist flowing from the upstream side in the X' direction flows to the downstream side.

Arrangement Example 4

Figure 19A:
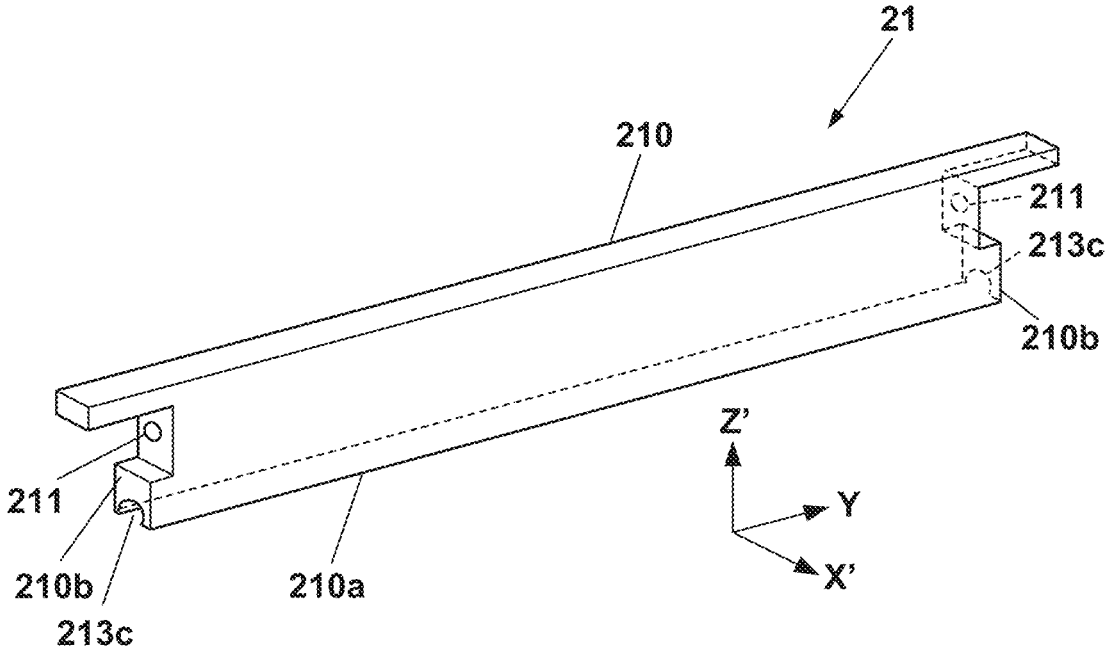
FIGS. 19A and 19B are a perspective view and a bottom view, respectively, of the suction head of still another example.
Figure 19B:
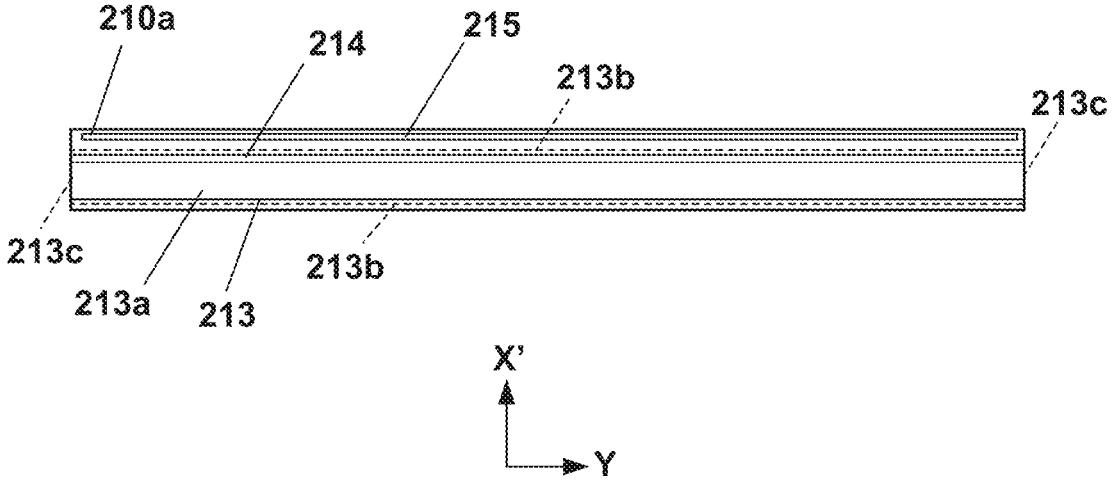

In the example shown in FIG. 10, the arrangement is employed in which the air in the suction groove 213 is forcibly exhausted by the exhaust section 212 and the exhaust unit 23. However, the arrangement may be employed in which the end portion of the suction groove 213 is opened to naturally exhaust the air in the suction groove 213. FIGS. 19A and 19B are a perspective view and a bottom view, respectively, of the suction head 21 showing an example of this arrangement. In the illustrated example, each open end portion 213*c* of the suction groove 213 in the Y direction is opened in each end portion 210*b* of the main body 210. Since the opening portion 213*a* of the suction groove 213 faces the transfer member 2 and is located close to it, the air in the suction groove 213 easily flows out from the open end portions 213*c* to the outside. When the air is blown out from the outlet portion 214*a* of the nozzle 214, a swirling flow generated by the blown air becomes a spiral swirling flow towards the open end portion 213*c* and can be exhausted from the open end portion 213*c*. The air containing mist exhausted from the open end portion 213*c* flows out in the direction away from the printhead 30, so that the adhesion to the printhead 30 is suppressed.

It is advantageous to use this arrangement example in combination with the arrangement as illustrated in FIG. 14, in which the outlet direction of the outlet portion 214*a* is inclined in the Y direction, in terms of the exhaust from the open end portion 213*c*.

Other Arrangement Examples

In terms of facilitating the generation of a spiral swirling flow in the suction groove 213, a spiral groove may be formed in the inner wall surface 213*b*. By being guided by this groove, the spiral swirling flow is easily generated.

In each of the arrangement examples described above, each of the outlet portion 214*a* and the outlet portion 215 is arranged as a single line configuration in the Y direction or on a single row in the Y direction, but a multiple lines configuration or a multiple rows configuration may be adopted.

Another Embodiment

Figure 20A:
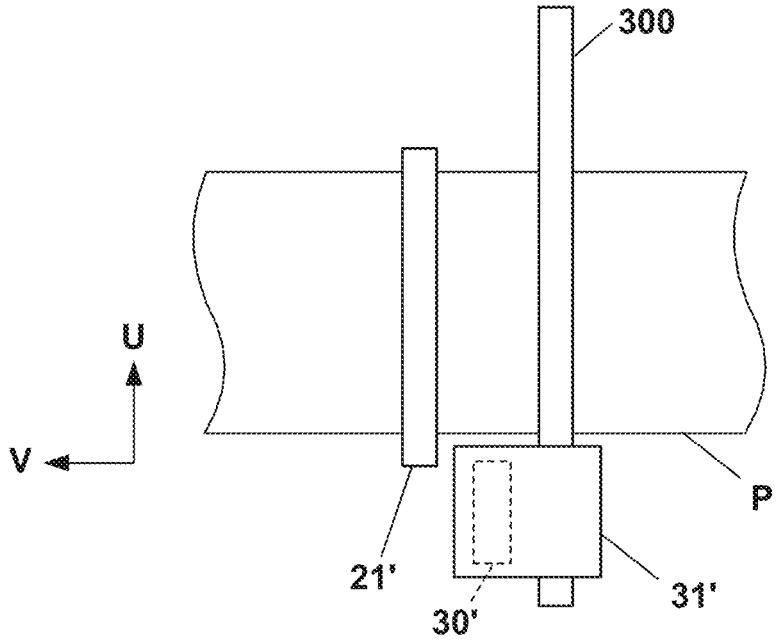
FIGS. 20A and 20B are explanatory views showing examples of application of the collecting unit to a serial type printing apparatus.
Figure 20B:
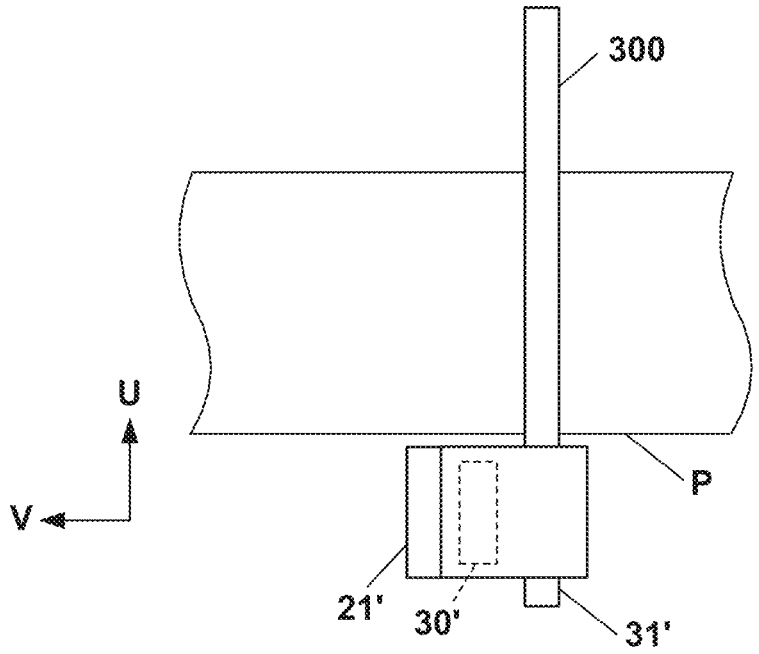

In the above-described embodiment, the example has been described as the application example of the collecting unit 100, in which the printhead 30 discharges ink to the transfer member 2 to form an ink image and the ink image is transferred to the print medium P. However, the collecting unit 100 of the above-described embodiment is also applicable to an apparatus in which printhead 30 directly discharges ink to the print medium P to form an image. FIGS. 20A and 20B show examples of this arrangement, and particularly show examples of the application to a serial type inkjet printer.

In the example shown in FIG. 20A, a printhead 30' is mounted on a carriage 31', and the carriage 31' is configured to reciprocally move in a main scanning direction by the guide of a guide shaft 300. When the carriage 31' moves, the printhead 30' discharges ink to a print medium P such as a paper sheet. The print medium P is intermittently moved (conveyed) in a sub-scanning direction V. An image is printed on the print medium P by alternately repeating the intermittent movement of the print medium P in the sub-scanning direction V and the discharge of the ink from the printhead 30' during the reciprocating movement of the carriage 31' in the main scanning direction U.

A suction head 21' corresponding to the suction head 21 in each of the above-described embodiments is fixedly arranged on the downstream side of the printhead 30' in the moving direction (V direction) of the print medium P so as to cross the print medium P in the main scanning direction U.

The example shown in FIG. 20B has basically the same arrangement as the example shown in FIG. 20A, but the suction head 21' is mounted on the carriage 31' and moves in the main scanning direction U together with the carriage 31'.

Note that the printing apparatus that discharges ink to perform printing has been exemplified in each of the above-described embodiments, but the present invention is applicable to a discharge apparatus that discharges a liquid such as a resin other than ink to a medium, and mist of the liquid can be collected using the collecting unit 100 of each of the above-described embodiments.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-222265, filed Dec. 9, 2019, which is hereby incorporated by reference herein in its entirety.

What is claimed is:

1. A discharge apparatus comprising:
a discharge unit configured to discharge a liquid to a medium; and
a suction unit including:
an opening facing the medium;
a suction groove including an arc-shaped inner wall surface inside the opening and configured to suck mist around the medium; and
an outlet portion configured to blow out a gas supplied from a supply unit, which supplies the gas to the suction unit, and face a part of the arc-shaped inner wall surface in a direction in which the gas blows out from the outlet portion.

2. The apparatus according to claim 1, wherein the suction unit further comprises an exhaust section provided at a position of an end of the inner wall in a direction intersecting the arc of the inner wall surface and configured to exhaust a gas inside the inner wall surface.

3. The apparatus according to claim 2, wherein
the medium is moved in a first direction with respect to the discharge unit and the suction unit,
the suction unit and the suction groove are extended in a second direction intersecting the first direction, and
the exhaust section is provided in one end portion or both end portions of the suction unit in the second direction so as to communicate with the suction groove.

4. The apparatus according to claim 3, further comprising an exhaust unit configured to exhaust air in the suction groove via the exhaust section.

5. The apparatus according to claim 1, wherein
an air outlet direction of the outlet portion is directed to the inner wall surface of the suction groove.

6. The apparatus according to claim 1, wherein
the outlet portion is disposed at an edge of the opening of the suction groove.

7. The apparatus according to claim 3, wherein
at least a part of a profile of a cross-section along the first direction of the suction groove is arc-shaped.

8. The apparatus according to claim 3, wherein
an entire profile of a cross-section along the first direction of the suction groove is arc-shaped.

9. The apparatus according to claim 3, wherein
the outlet portion is extended in the second direction, and
the suction unit includes an introduction section to which air from the supply unit is introduced, and a pressure chamber extended in the second direction and provided between the introduction section and the outlet portion.

10. The apparatus according to claim 9, wherein
the suction unit includes a pressure adjusting portion provided between the pressure chamber and the outlet portion and configured to promote uniformization of an air pressure distribution in the second direction.

11. The apparatus according to claim 9, wherein
the suction unit includes a plurality of passage closing portions arranged in a passage between the pressure chamber and the outlet portion and arranged in a comb-tooth shape in the second direction.

12. The apparatus according to claim 9, wherein
the suction unit comprises a porous body extended in the second direction and configured to allow the pressure chamber and the outlet portion to communicate with each other.

13. The apparatus according to claim 1, wherein
the suction unit includes a second outlet portion configured to blow out air supplied from the supply unit to the medium.

14. The apparatus according to claim 1, wherein
the medium is a transfer member that cyclically moves,
the discharge unit forms a liquid image on the cyclically moving transfer member, and
the apparatus further comprises a transfer unit configured to transfer the liquid image formed on the transfer member by the discharge unit to a print medium.

15. The apparatus according to claim 3, wherein
the suction unit is arranged adjacent to the discharge unit in the first direction.

16. A suction unit comprising:
an opening facing a medium;
a suction groove including an arc-shaped inner wall surface inside the opening and configured to suck mist around a medium to which a liquid is discharged; and an outlet portion configured to blow out a gas supplied from a supply unit, which supplies the gas to the suction unit, and face a part of the arc-shaped inner wall surface in a direction in which the gas blows out from the outlet portion.

17. The suction unit according to claim 16, further comprising an exhaust section provided at a position of an end of the inner wall surface in a direction intersecting the arc of the inner wall surface and configured to exhaust a gas inside the inner wall.

18. The apparatus according to claim 1, wherein an air outlet direction of the outlet portion is directed so as to generate a swirling flow along the arc-shaped inner wall surface.

19. The suction unit according to claim 16, wherein an air outlet direction of the outlet portion is directed so as to generate a swirling flow along the arc-shaped inner wall surface.

* * * * *